United States Patent [19]

Knell et al.

[11] 4,175,907

[45] Nov. 27, 1979

[54] SHOVEL LINKAGE

[75] Inventors: Harvey A. Knell, Yorkville, Ill.; Stephen H. Gill, Mentor, Ohio

[73] Assignee: Caterpillar Tractor Co., Peoria, Ill.

[21] Appl. No.: 813,728

[22] Filed: Jul. 7, 1977

[51] Int. Cl.[2] ..... E02F 3/38

[52] U.S. Cl. ..... 414/715; 52/115; 212/144; 414/727

[58] Field of Search ..... 214/135, 138 R, 140, 214/145 R, 770, 773, 776, 777; 212/144; 182/2, 228; 52/115, 116, 117, 119

[56] References Cited

U.S. PATENT DOCUMENTS

| | | | |
|---|---|---|---|
| 2,560,674 | 7/1951 | Westall | 214/138 R X |
| 2,770,372 | 11/1956 | Martinson | 212/144 |
| 2,965,253 | 12/1960 | Poulter et al. | 214/138 R |
| 3,327,385 | 6/1967 | Shaver | 182/228 X |
| 3,336,684 | 8/1967 | Ulrich | 214/140 X |
| 3,411,647 | 11/1968 | Zimmerman | 214/776 X |
| 3,862,697 | 1/1975 | Gill et al. | 214/138 R X |

*Primary Examiner*—L. J. Paperner
*Attorney, Agent, or Firm*—Phillips, Moore, Weissenberger, Lempio & Majestic

[57] ABSTRACT

A shovel linkage for a hydraulic excavator or the like has spaced parallel boom link rails which are coplanar with associated spaced parallel stick link rails and pivotedly connected thereto by means of pivot joints provided on the ends thereof.

Bucket stops are provided on a bucket attached to the stick and are arranged to contact the centers of the stick rails for greater strength.

9 Claims, 10 Drawing Figures

SHOVEL LINKAGE

BACKGROUND OF THE INVENTION

The present invention relates to the linkage construction for a hydraulic excavator. Typically the shovel linkage for such excavators includes a boom pivotedly connected to the frame of the excavator, and a stick pivotedly connected to the boom and having its distal end adapted for fitting with a bucket or other digging implement. The construction of the prior art boom and stick comprises spaced parallel side plate members joined by top and bottom plate members to form a generally rectangular box-like construction. The distal end of the boom typically has offset brackets extending from the sides thereof which are provided with pivots which are connected with mating pivots on the stick by means of pins, whereby the side walls of the stick are embraced between the sidewalls of the boom. As a result forces transmitted between the boom and stick through such pivot joints result in torsional loads on the boom and stick side walls.

SUMMARY OF THE INVENTION

It is an object of the present invention to provide a shovel linkage for a hydraulic excavator wherein the links are connected in line to avoid bending moments induced by the offset brackets of the prior art.

It is also an object of the present invention to provide a shovel linkage for a hydraulic excavator which eliminates torsional loads in the members thereof.

These and other objects and advantages are achieved in the present invention wherein the shovel linkage boom and stick comprise spaced parallel rail members joined by cross tubes therebetween and having cooperating pivots provided in the mating ends thereof whereby the respective rails of the boom and stick will be coplanar, avoiding torsional loads transmitted therebetween.

This absence of torsional loads in the boom and stick rails permits reduction in a number of cross members joining the rails while providing a shovel linkage of greater strength than that provided by the prior art.

The pivots provided in the ends of the boom and stick allow the use of shorter pivot pins, and the associated reduction of bending moments therein.

Bucket stops provided on the bucket implement on the end of the linkage are arranged to cooperate with stops provided in the center of the boom (stick) rails for better strength and further elimination of torsional loads.

DESCRIPTION OF THE PREFERRED EMBODIMENT

Figure 1:
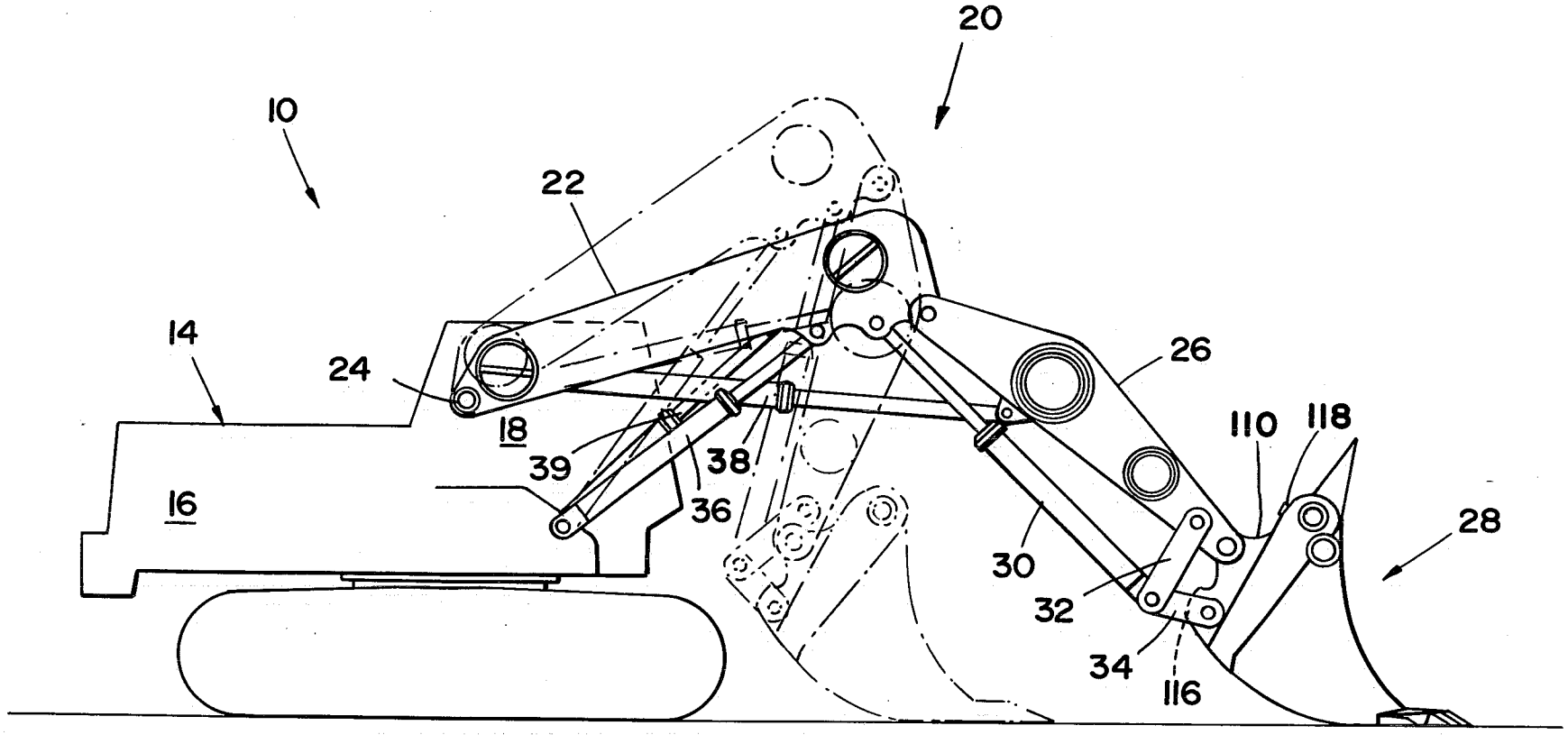
FIG. 1 is an elevational view of shovel linkage embodying the present invention.

Referring to FIG. 1, a shovel linkage for a hydraulic excavator, which comprises an undercarriage 12 and a frame 14 rotatable mounted thereon and supporting an engine compartment 16 and an operator's cab 18, is shown generally at 20. The shovel linkage includes a boom 22 pivotedly mounted on the excavator frame by means of pivots 24, and a stick 26 pivotedly connected to the boom in a manner to be hereinafter described. Pivotedly attached to the distal end of the stick is a bucket 28 which is controllable by means of a hydraulic jack 30 connected to links 32 and 34 which in turn are pivotedly connected to the stick and bucket respectively.

Hydraulic jacks 36 pivotedly connected to the excavator frame and to the outer end of the boom controls motion of the boom, and hydraulic jacks 38 pivotedly connected to the boom and to a stick controls movement of the stick with respect to the boom.

A master cylinder 39 if pivotedly connected to the excavator frame and to the outer portion of the boom to control bucket attitude upon raising of the boom.

Figure 2:
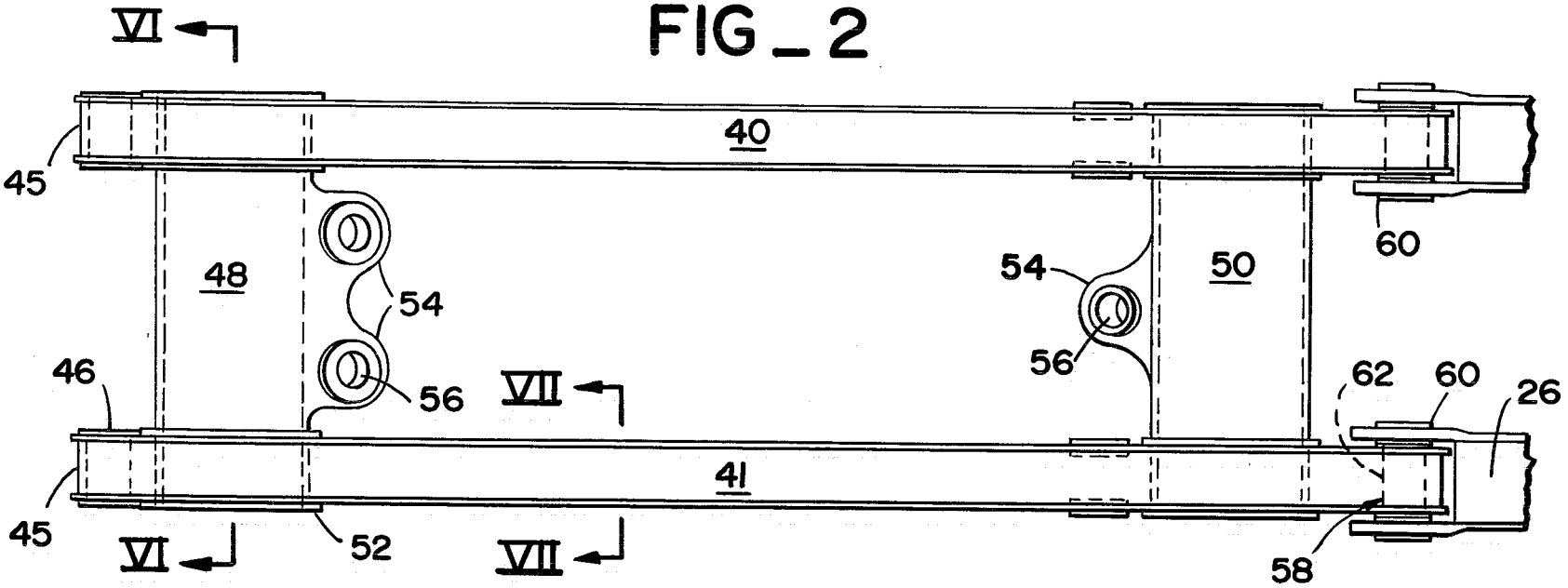
FIG. 2 is a plan view of the boom link of the shovel linkage shown in FIG. 1.
Figure 3:
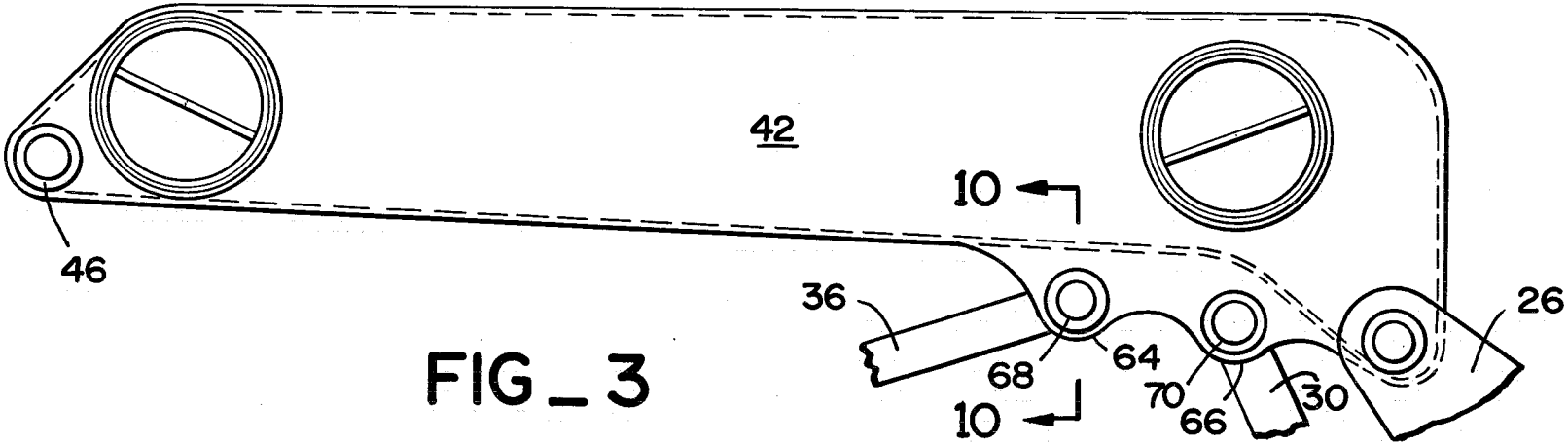
FIG. 3 is a side elevational view of the boom link of the shovel linkage of the present invention.
Figure 7:
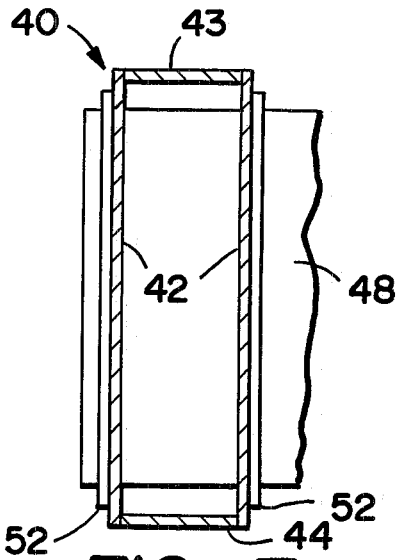
FIG. 7 is a sectional view of a boom rail of the present invention taken along the line and in the direction indicated by the arrows 7—7 in FIG. 2.

Referring to FIGS. 2 and 3, boom 22 comprises a pair of spaced, parallel rails 40 and 41, being of a generally box-like cross section and comprising spaced, parallel side walls 42 joined by parallel top and bottom walls 43 and 44, as shown in FIG. 7. Pivots 24 provided in one end of the boom rails comprise cylindrical sleeves 45 disposed between the side walls of the rails and retained therein by conventional means.

Rails 40 and 41 are interconnected by means of cross tubes 48 and 50 comprising cylindrical members which are secured therebetween by flanges 52 welded to the tubes immediately outward of the two outside walls of each of the rails.

Attached to each of the cross tubes are tabs 54 having pivots 56 provided therein for attachment of hydraulic cylinders 38 thereto.

The outer ends of the boom rails are also provided with pivots 58 similar to pivots 24 comprising cylindrical sleeves 62 secured therein.

The lower forward portion of sidewalls 42 rails 40 and 41 are provided with depending tabs 64 and 66 having pivots 68 and 70 provided therein for connection of boom jacks 36 and bucket jacks 30 thereto respectively, intermediate the side walls of each rail. Accordingly, the boom and bucket jacks are on the longitudinal center lines of the boom and stick rails. Thus the loads imparted by these cylinders are transmitted down the center line of the boom.

Figure 4:
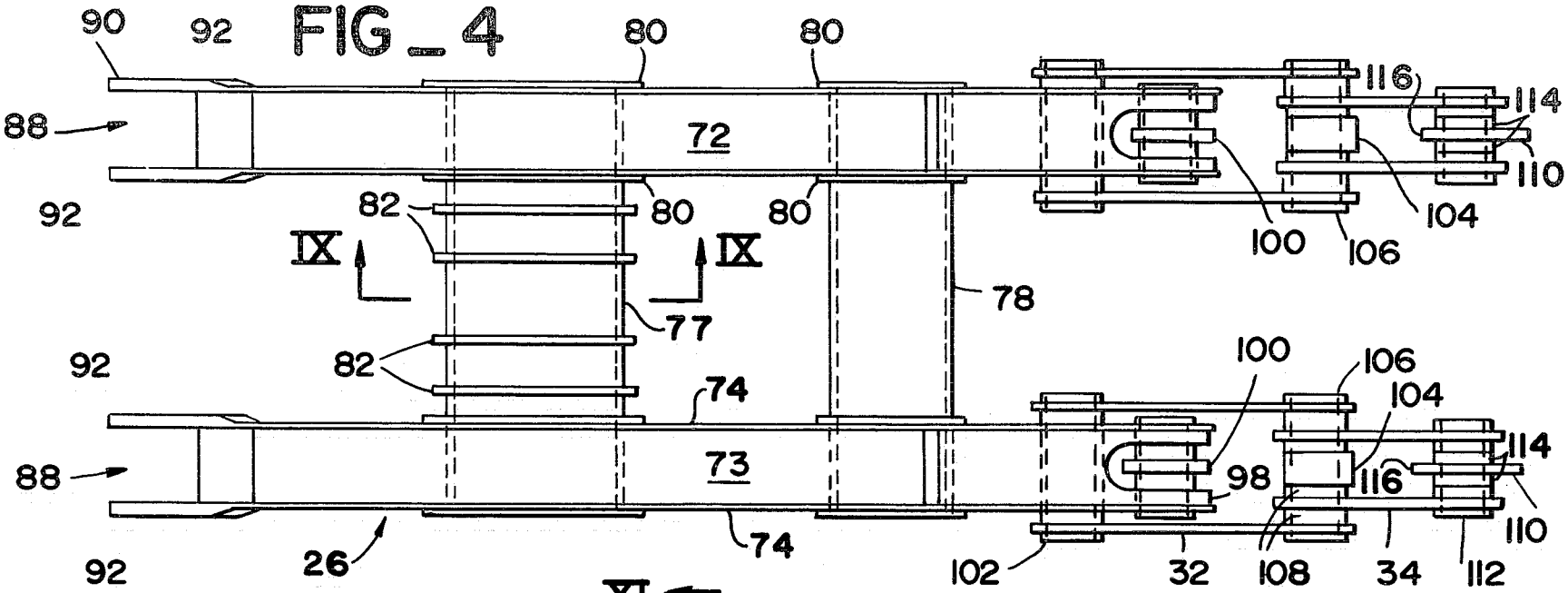
FIG. 4 is a plan view of the stick link of the present invention.
Figure 5:
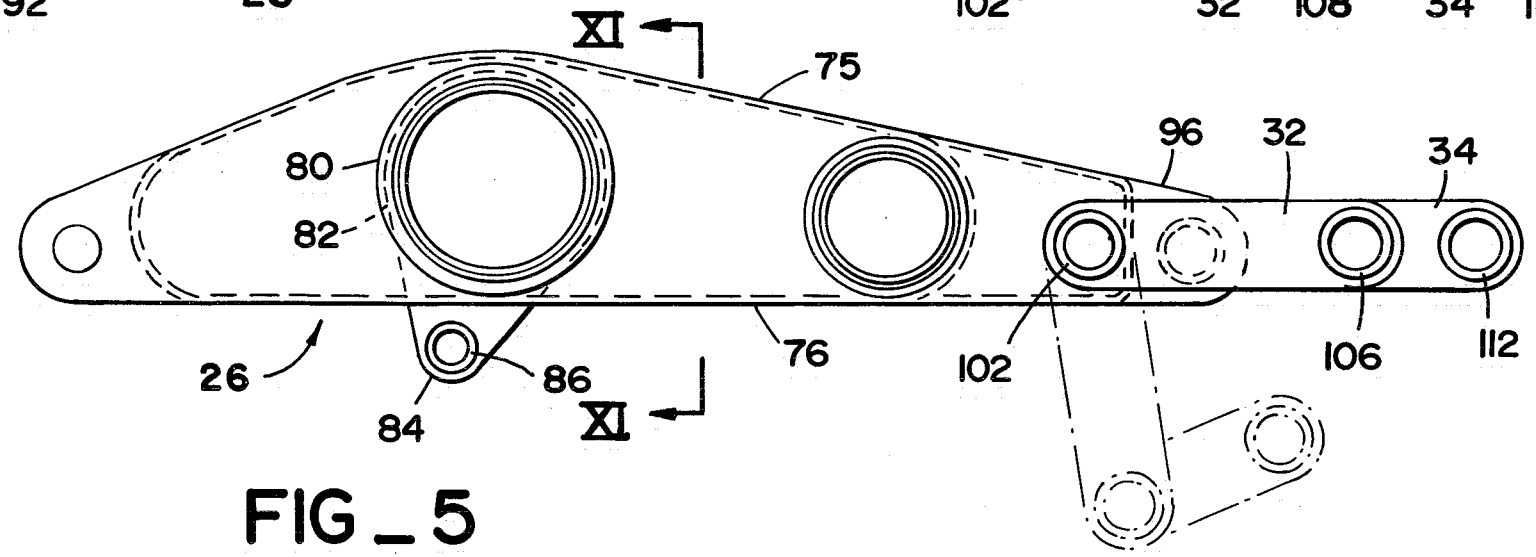
FIG. 5 is a side elevational view of the stick link of the present invention.
Figure 6:
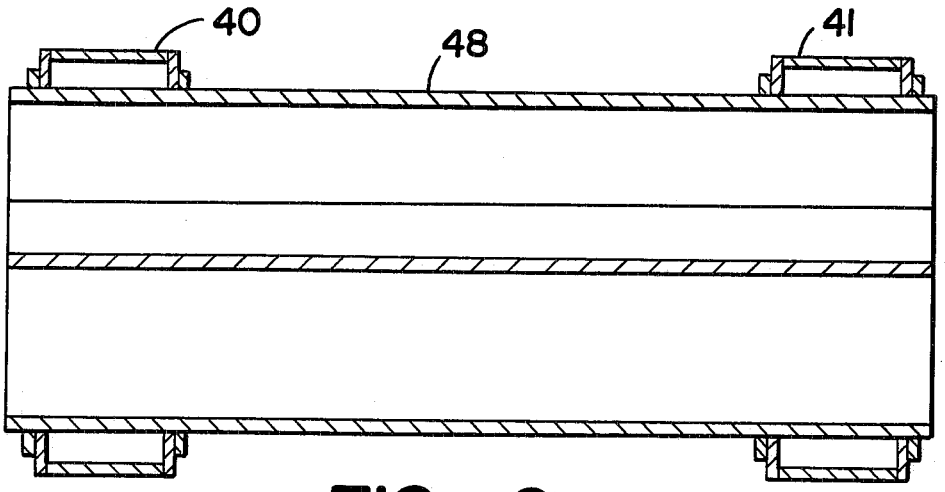
FIG. 6 is a sectional view of the boom link of the present invention taken along the line and in the direction indicated by the arrows 6—6 in FIG. 2.

Referring to FIGS. 4 and 5, stick 26 also comprises a pair of spaced parallel rails 72 and 73 comprising box sections having sidewalls 74 joined by top and bottom walls 75 and 76. The rails are joined by cross tubes 77 and 78 comprising cylindrical members which project through appropriate openings in the side walls of the rails and are retained therein by flanges 80 secured to the cylindrical members immediately adjacent to the outside edges of the rail sidewalls. Provided on cross tube 77 are collars 82 which include depending ears 84 having pivots 86 provided therein for connection of the rod ends of the hydraulic jacks 38 thereto.

Figure 8:
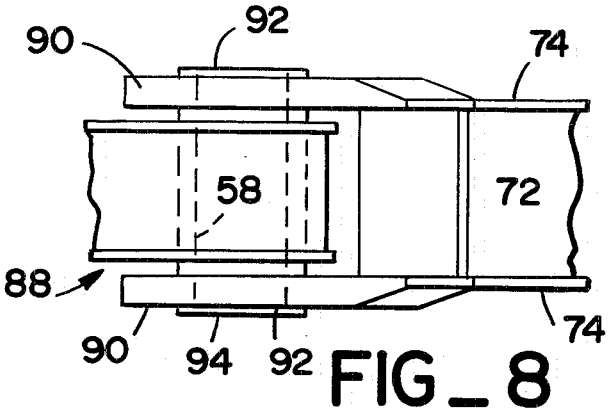
FIG. 8 is an enlarged view of the junction of the boom and stick rails of the present invention.
Figure 10:
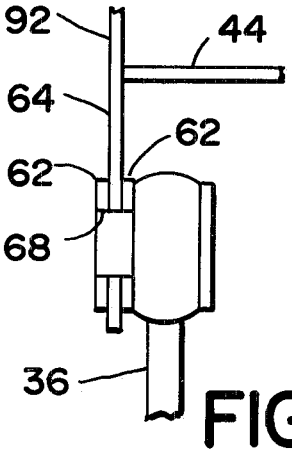
FIG. 10 is a sectional view of the rod pivot joint of the present invention taken along the line in the direction indicated by the arrows 10—10 in FIG. 3.
Figure 9:
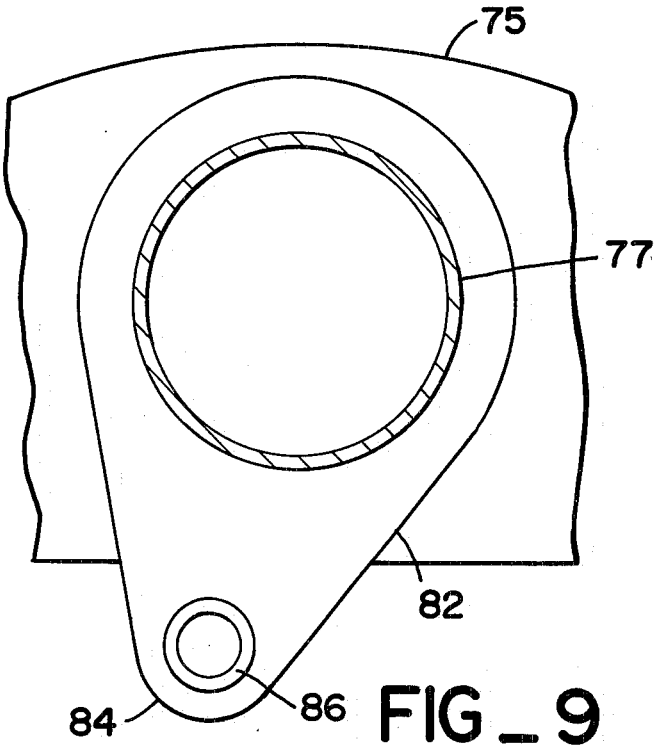
FIG. 9 is a sectional view of the stick link cross tube shown in FIG. 4 taken along the line in the direction indicated by the arrows 9—9.

As seen in FIGS. 4 and 8, one end of stick rails 72 and 73 are adapted for pivotal connection with the outer ends of the boom rails, and have bifurcated ends 88 provided by extended portions 90 of the rail sidewalls which project beyond the top and bottom walls joining the rail sidewalls and have pivot journals 92 provided therein whereby the extended portions of the rail sidewalls are adapted to embrace the outer ends of the boom rails wherein the pivot journals 92 will be in coaxial alignment with the pivot 58 provided in the boom rails for pivotal connection therewith by means of pins 94. As shown in FIG. 8, this construction results in rails 72 and 73 of stick 26 being disposed in direct alignment with the rails 40 and 41 of boom 22. Thus forces transmitted between the boom and stick through the pivot joints impart no torsional loads to the boom or stick rails. In addition, pins 94 may be kept relatively short, being little longer than the width of the boom and stick rails, and are symetrically loaded in a manner which will minimize bending moments in the pins.

The other, distal end of stick 26 is bifurcated by a similar extension of the rail sidewalls beyond the top and bottom walls thereof, and said extended end portion, 96 is also provided with pivots 98 for pivotal connection with a bracket 100 provided on bucket 28. Links 32 and 34 are pivotedly connected with the end of hydraulic cylinder 30 and the stick and bucket respectively for selective rotation of the bucket with respect to the stick. As shown in FIG. 4, parallel links 32 are pivotedly mounted on the stick by means of cylindrical pivot pins 102 extending through each of the stick rails 72 and 73, and are pivotedly connected with a pivot 104 provided in the cylinder end of hydraulic cylinder 30 by means of a pin 106 outboard of parallel links 34 and spaced therefrom and from 104 by spacers 108. Links 34 are in turn pivotedly connected to a bracket 110 provided on the rear of bucket 28, by means of pivot pins 112 and spacers 114. Bracket 110 has a flatened edge 116 which is disposed to engage the bottom of the stick rails upon a retraction of cylinder 30, and thus serves as a stop means for bucket 28. As seen in FIG. 4, bracket 110 and edge 116 on each side of the bucket are in line with the stick rails and will engage the rails upon full retraction of hydraulic cylinder 30 at the center thereof, avoiding unsymetrical loading of the stick rails.

The top of the stick will also have a stop 118 which is similar to that described above. This stop stops rotation of the bucket upon extension of the bucket cylinders.

The embodiments of the invention in which an exclusive property or privilege is claimed are defined as follows:

1. A shovel linkage for a hydraulic excavator or the like comprising a boom pivotedly mounted on said excavator and actuable by first hydraulic cylinder means pivotedly connected to said excavator and said boom, and a stick pivotedly connected to said boom at the distal end thereof and actuable with respect to said boom by second hydraulic cylinder means pivotedly connected to said stick and said boom, said stick having its distal end adapted for attachment of bucket means thereto, and wherein said boom and said stick comprise spaced parallel rails, said rails having side walls joined by top and bottom walls in a generally box-like configuration, and cross tubes connecting said boom rails and said stick rails, said cross tubes comprising cylindrical members extending through the sidewalls of said rails, and between said rails and having flanges secured thereto immediately adjacent to the side walls of the rails, and wherein the ends of the boom rails have pivots provided therein which comprise cylindrical journals extending through said rails, and wherein the first ends of the stick rails are bifurcated and have pivots provided in the bifurcated portion thereof whereby the stick rails are pivotedly connected to the boom rails in line with said boom rails, and wherein the second ends of the stick rails are pivotedly connected to a bucket, said bucket having outstanding, apertured brackets provided on the rear thereof, and wherein said second stick rail ends are bifurcated and have coaxial pivot journals provided in said bifurcated portions, and wherein the bucket brackets are disposed between the bifurcated portions of the stick rail ends and are pivotedly connected thereto by means of pivot pins extending through said pivot journals in the bifurcated portions of the stick rails and the apertures in the brackets, and further comprising first parallel links pivotedly connected to the stick rails on either side thereof near the distal end thereof, and second parallel links pivotedly connected to the bucket means and to said first parallel links, and hydraulic actuator means pivotedly connected to the boom rails and to the first and second parallel links at the pivotal connection thereof, whereby the bucket means may be selectively rotated with respect to the stick by means of said actuator means.

2. The shovel linkage defined in claim 1 wherein the cross tubes in said boom and said stick have brackets provided thereon, wherein said second hydraulic cylinder means is pivotedly connected to brackets provided on cross tubes in said boom and said stick for actuation of the stick with respect to the boom.

3. A shovel linkage for a hydraulic excavator or the like comprising a boom pivotedly mounted on said excavator and actuable by first hydraulic cylinder means pivotedly connected to said excavator and said boom, and a stick pivotedly connected to said boom at the distal end thereof and actuable with respect to said boom by second hydraulic cylinder means pivotedly connected to said stick and said boom, said stick having its distal end adapted for attachment of bucket means thereto, and wherein said boom and said stick comprise spaced parallel rails, said rails having side walls joined by top and bottom walls in a generally box-like configuration, and cross tubes connecting said boom rails and said stick rails, said cross tubes comprising cylindrical members extending through the sidewalls of said rails, and between said rails and having flanges secured thereto immediately adjacent to the side walls of the rails; and wherein the side walls of the boom rails include portions near the distal end thereof which depend below the bottom walls and have axially aligned pivot means provided therein, and wherein ends of said first hydraulic cylinder means are pivotally connected therebetween, whereby forces exerted by said cylinders will by transmitted along the centerlines of the boom and stick rails.

4. The shovel linkage defined in claim 3 wherein the ends of the boom rails have pivots provided therein which comprise cylindrical journals extending through said rails, and wherein a first end of the stick rails are bifurcated and have pivots provided in the bifurcated portion thereof whereby the stick rails are pivotedly connected to the boom rails in line with said boom rails.

5. The shovel linkage defined in claim 4 wherein the bifurcated ends of the stick rails comprise extensions of the side walls of said stick rails, and wherein said extensions have pivot journals provided therein in coaxial alignment with the pivot journals in the boom rails, and further comprising pin means pivotedly connecting the boom rails to the stick rails.

6. The shovel linkage of claim 4 wherein the second ends of the stick rails are pivotedly connected to a bucket, said bucket having outstanding, apertured brackets provided on the rear thereof, and wherein said second stick rail ends are bifurcated and have coaxial pivot journals provided in said bifurcated portions, and wherein the bucket brackets are disposed between the bifurcated portions of the stick rails ends and are pivotedly connected thereto by means of pivot pins extending through said pivot journals in the bifurcated portions of the stick rails and the apertures in the brackets.

7. The shovel linkage defined in claim 6 wherein said bucket has stop means provided on the rear thereof which is arranged to contact the stick rails along the center line thereof upon full rotation of the bucket with respect to the stick.

8. The shovel linkage defined in claim 3 wherein said cross tubes comprise cylindrical members which extend through apertures provided in the side walls of the boom and stick rails respectively, and flanges affixed to said cylindrical members immediately adjacent to the outside surfaces of said side walls.

9. A shovel linkage for a hydraulic excavator or the like comprising a boom pivotedly mounted on said excavator and actuable by first hydraulic cylinder means pivotedly connected to said excavator and said boom, and a stick pivotedly connected to said boom at the distal end thereof and actuable with respect to said boom by second hydraulic cylinder means pivotedly connected to said stick and said boom, said stick having its distal end adapted for attachment of bucket means thereto, and wherein said boom and said stick comprise spaced parallel rails, said rails having side walls joined by top and bottom walls in a generally box-like configuration, and hydraulic actuator means pivotedly connected to the boom rails and pivotedly associated with the bucket means whereby the bucket means may be selectively rotated with respect to the stick by means of said actuator means; and wherein the side walls of the boom rails include portions near the distal end thereof which depend below the bottom walls, and have axially aligned pivot means provided therein, and wherein ends of said hydraulic actuator means are pivotally connected therebetween whereby forces exerted by said actuator are transmitted along the centerlines of the boom and stick rails.

* * * * *